US006443817B1

(12) United States Patent
McCarter et al.

(10) Patent No.: US 6,443,817 B1
(45) Date of Patent: Sep. 3, 2002

(54) METHOD OF FINISHING A SILICON PART

(75) Inventors: Douglas Ronald McCarter; Matthew Maynard Tangedahl, both of Deer Park; Mitchell Clarey Garcia, LaPorte; Kal Kevin Meier, Deer Park, all of TX (US)

(73) Assignee: McCarter Technology, Inc., Deer Park, TX (US)

( * ) Notice: Subject to any disclaimer, the term of this patent is extended or adjusted under 35 U.S.C. 154(b) by 11 days.

(21) Appl. No.: 09/778,525

(22) Filed: Feb. 6, 2001

(51) Int. Cl.[7] ..... B24B 1/00

(52) U.S. Cl. ..... 451/57; 451/56; 451/65; 451/41; 451/488; 451/72

(58) Field of Search ..... 451/57, 21, 56, 451/463, 43, 44, 65, 72, 488, 449

(56) References Cited

U.S. PATENT DOCUMENTS

| | | | | | |
|---|---|---|---|---|---|
| 5,658,189 | A | * | 8/1997 | Kagamida | 451/66 |
| 5,718,620 | A | * | 2/1998 | Tanaka et al. | 451/288 |
| 5,827,112 | A | * | 10/1998 | Ball | 451/21 |
| 5,910,040 | A | * | 6/1999 | Moriyasu et al. | 451/5 |
| 6,050,880 | A | * | 4/2000 | Kato et al. | 451/41 |
| 6,099,389 | A | * | 8/2000 | Nichols et al. | 451/36 |
| 6,116,464 | A | * | 9/2000 | Ohmori et al. | 451/41 |
| 6,217,420 | B1 | * | 4/2001 | Stocker et al. | 451/43 |
| 6,227,949 | B1 | * | 5/2001 | Yi et al. | 451/57 |

OTHER PUBLICATIONS

K.E. Puttick, et al.: "Single–point diamond machine glasses", Proc. R. Soc. Lond A, vol. 426, Great Britain (1989),pp. 19–30.

K.E. Puttick, et al.: Letter to the Editor, "Surface damage in nanomachined silicon", Semicond. Sci. Technol. 7, UK (1992), pp. 255–259.

K.E. Puttick, et al.: "Transmission Electron Microscopy of Nanomachined silicon crystals", Philosophical Magazine A, (1994), vol. 69, No. 1, pp. 91–103.

K.E. Puttick, et al.: "Size effects in abrasion of brittle materials,", J. Phys. D.: Appl. Phys., vol. 12, Great Britain, (1979), pp. 195–202.

S. Danyluk, et al.: "Influence of Fluids on the Abrasion of Silicon By Diamond", University of Illinois at Chicago Circle, 20 pages.

M.J. Ball, et al.: "Cost Effective Edge Machining of Silicon Wafers to Minimize The Polishing Process", 1998 Spring Tropical Meeting vol. 17, pp. 50, 51, 53 plus 3 pages.

M. Kerstan, et al.: "Ultraprecision Grinding and Single Point Diamond Turning of Silicon Wafers and their Characterization", 1998 Spring Tropical Meeting, vol. 17, pp. 32–35.

R. B. Soper: "Mechanical Damage–Its Role in Silicon Surface Preparation", National Bureau of Stds. Report 337, (1970) pp. 412–418.

S. Danyluk: Progess Report to the U.S. Department of Energy Jet Propulsion Laboratory Flat–Plate Solar Array Project, Jan. 1984 Contract No. 956053, Surface Property Modification of Silicon, 2 pages Abstract, Acknowledgement page, 2 pages Summary, pp. 7–42, 40 Figures.

* cited by examiner

*Primary Examiner*—George Nguyen
(74) *Attorney, Agent, or Firm*—Browning Bushman P.C.

(57) ABSTRACT

An improved method of finishing a silicon part utilizes a rotatable grinding wheel having diamond particles and a bonding agent, and a plurality of grit materials. The grinding wheel is dressed to form a wheel with a grinding surface having a plurality of diamond particles, and thereafter a bonding agent is removed from the grinding wheel surface without significant removal of the plurality of diamond particles. An enhanced lubricity material may be applied to the grinding wheel, and the surface of the silicon part then ground, preferably while cooling the silicon part. The surface of the silicon part may then be finished with a plurality of grit materials. A single digit RMS surface finish on a silicon part may be obtained.

20 Claims, 4 Drawing Sheets

METHOD OF FINISHING A SILICON PART

FIELD OF THE INVENTION

The present invention relates to techniques for finishing a surface of a part. More particularly, the present invention relates to improved techniques for obtaining a quality finish on a silicon part at a relatively low cost.

SUMMARY OF THE INVENTION

Those involved in the manufacture of parts have long recognized the benefits to improved surface finishing techniques. The market for many parts could be increased if the part could be provided with a better surface finish or with a quality surface finish at a lower cost.

Different materials obviously require different equipment and techniques for obtaining the desired surface finish. Within the past decade, there has been an increased emphasis upon parts formed from materials not commonly used in the part manufacturing business. Those skilled in the design of equipment have long recognized the benefits of a part formed from a silicon material, since silicon has unusually high quality characteristics which are highly desirable for certain applications. In spite of the limitations associated with providing a desired finish on a silicon part, silicon parts have been increasing in popularity, particularly for unique applications in the electronics, telecommunications, and space industries.

Manufacturers have long been able to make a thin slice from a silicon block, thereby forming a desired number of silicon wafers. Conventional technology thus is able to grow a silicon crystal, and from that crystal obtain sliced silicon wafers. In general, however, it has been considered impractical to provide techniques to provide a desired surface finish on silicon parts other than flat planar wafers, primarily because of the tendency of a silicon part to shatter when mechanical forces are applied to the surface during the finishing operation.

Silicon parts have been manufactured and the surface of such parts conventionally machined with a conventional fine grit wheel. This finishing technique produces a surface which is acceptable for some applications, but does not produce a highly smooth surface, with minimum surface and subsurface damage, to meet the desires of many users. Accordingly, the market for materials formed from silicon, fused silica, silicon carbide, and similar materials has been limited due to the difficulty and cost associated with providing a desired finish on the silicon part. The term "silicon part" as used herein means a part formed substantially from one or more of silicon, fused silicon, and/or silica carbide.

While many applications conceivably could benefit from improvements in both the part machining and finishing techniques, optical elements constitute a class of goods wherein finishing techniques have been most beneficial. In the sequencing of machining, lapping, and polishing an optical element, it is machining that proceeds most rapidly but usually results in a surface of low quality by optical standards. Subsequent lapping and polishing constitute a large amount of the total fabrication time, but significantly enhance the quality of the machined surface. Finishing techniques applied to optical elements thus evidence the importance of a quality machined surface to reduce the time required for lapping and polishing, and thereby reduce the time required to manufacture the finished component.

In order to perform their desired function, most silicon parts cannot practically be used as wafers, since more complex geometries are generally required. Using conventional technology, three dimensional silicon parts have been manufactured and surfaces finished within the ballpark of from 20 to 50 RMS. Prior art techniques used to finish a silicon part generally include a two body method (part rotates and/or reciprocates; wheel rotates) which uses a no pitch abrasive, and a three body method (part rotates, wheel rotates, pitch is used) which uses pitch and a rotating grinding action. Both of these methods result in subsurface damage to the silicon part, and are time consuming.

One of the primary problems with these prior art techniques is that the process of obtaining this desired finish results in the fracture of a very high percentage of parts. It is not uncommon in the process of seeking to obtain a desired finish of a silicon part to fully machine then start the finishing process with 100 parts, with the eventual hope of obtaining 5 useful finished pieces. Since the other 95 being ruined in the finishing process, these techniques are very time consuming to increase the acceptable part vote and, regardless of the time spent, a very high percentage of the machined parts fracture during the finishing process. At this high cost, surface finishing of silicon parts in the range of from 20 to 50 RMS have been obtained, but higher quality surface finishes in the range of 9 RM and less had been considered impractical.

Various articles have been written with respect to the machining of silicon and glass in the ductile mode, such as Puttick, K. E., Shabid, M. A. and Hosseini, M. M., "Size Effects in Abrasion of Brittle Materials", J. Phys. D: Appl. Polys., Vol. 12, 195–202, 1979; Puttick, K. E., et al., "Single-Point diamond Machining of Glasses", Proc. R. Soc. London A 426. 19–30, 1989; Puttick, K. E., et al., "Letter to the Editor—Surface Damage in Nanomachined Silicon", Sem. Cond. Sci. Technol. 7, 255–259, 1992; and Puttick, K. E., et al., "Transmission Electron Microscopy of Nanomachined Silicon Crystals", Philosophical Magazine, Vol. 69, No. 1, 91–103, 1994). Danyluk, S. and Reaves, R., "Influence of Fluids on the Abrasion of Silicon by Diamond", Wear 77 (1982) 81–87 and Danyluk, S., "Surface Property Modification of Silicon", NASA-CR-173952, January 1984 relate to the effect of the coolant formulation on the hardness of silicon surfaces. Kersian, M., et al., "Ultraprecision Grinding and Single Point Diamond Turning of Silicon Wafers and Their Characterization", Proc. ASPE Spring Topical Meeting on Silicon Machining, April 1998; Hashimoto, H. and Imai, Kl, "Epistemology and Abduction in Shear (Ductile)-Mode Grinding of Brittle Materials", Proc. ASPE Spring Topical Meeting on Silicon Machining, April 1998; and Ball, M. J., et al., "Cost Effective Edge Machining of Silicon Wafers to Minimize the polishing Process", Proc. ASPE Spring Topical Meeting on Silicon Machining, April 1998 teach that material removal should be done by many shallow cuts if damage is to be minimized. One reference suggests that the coolant may influence the nature of the surface being cut, although Chargin, D., "Cutting Fluid Study for Single Crystal Silicon", Proc. ASPE Spring Topical Meeting on Silicon Machining, April 1998 indicates that little benefit of coolants over deionized water obtained when SPDT is the method of material removal.

Kersian, M. et al. suggests that SSD may be machined in the range of 1 to 3.5 microns, while Ball, M. J. et al. suggests a range of from 2 to 5 microns. Using a 600 and 400 grit sample, Ball, M. J. et al. suggests subsurface damage level of 7 to 12 and 10 to 15 microns, respectively.

The disadvantages of the prior art are overcome by the present invention, and an improved method of finishing a silicon part utilizing a rotatable grinding wheel and one or more grip material is hereinafter disclosed.

SUMMARY OF THE INVENTION

The method of finishing a silicon composition part according to the present invention may be used to significantly reduce the amount of time to manufacture a silicon part, but also to significantly increase the percentage of parts which may be successfully finished without ruining the part. Finally, the present invention is particularly useful for finishing a silicon part to obtain a surface finish significantly below that achieved using prior art techniques.

The method according to the present invention uses a rotatable grinding wheel having diamond particles and a bonding materials. The method involves dressing the rotatable grinding wheel to form a grinding wheel surface having a plurality of diamond particles forming a substantially uniform particle grinding diameter. Thereafter, the bonding material is removed from the grinding wheel surface without significant removal of the plurality of diamond particles. An enhanced lubricity material, such a graphite, may then be applied to the grinding wheel. The operator may thereafter grind a surface of the silicon material part with the rotatable grinding wheel, and finally finish the ground surface of the silicon material part with one or more grit materials.

In a preferred embodiment, a plurality of grit materials are used which vary from about 200 grit to less than 800 grit. The silicon composition part may be cooled with a plurality of cooling lines both when grinding the silicon material part with the grinding wheel and when finishing the silicon material part with the one or more grit materials. The techniques of the present invention may be used to obtain a surface finish on a silicon part which has a value of less that 9 RMS.

It is an object of the present invention to provide improved techniques for removing subsurface damage and providing a high quality finish and a flatness to a finished surface of a silicon part which is significantly improved over the prior art, and to provide such a finish at a reduced time compared to prior art techniques.

It is another object of the present invention to significantly reduce or eliminate micro-subsurface damage to a silicon part during the finishing operation.

Still another object of the invention is to achieve a finish on a silicon part which may be conventionally machined, with that finish being achieved with both a minimal amount of time and no substantial subsurface damage.

It is a feature of the present invention to significantly reduce the time required to turn and lap a machined silicon part.

It is also a feature of this invention that the silicon part is cooled with a plurality of cooling lines both when grinding the silicon part with the grinding wheel and when finishing the silicon part with one or more grit materials.

It is a further feature of the invention to provide graphite as the enhanced lubricity material applied to the grinding wheel.

Still another feature of the invention is that the part is covered while grinding the surface of the part using an overhead cover having a surface area at least four times the maximum nominal diameter of the part.

It is an advantage of the present invention that many of the techniques and methods as taught herein for forming a silicon part with a desired surface finish may be performed in a conventional manner by changing the coolant and/or checking the machining or finishing the parts for defects.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
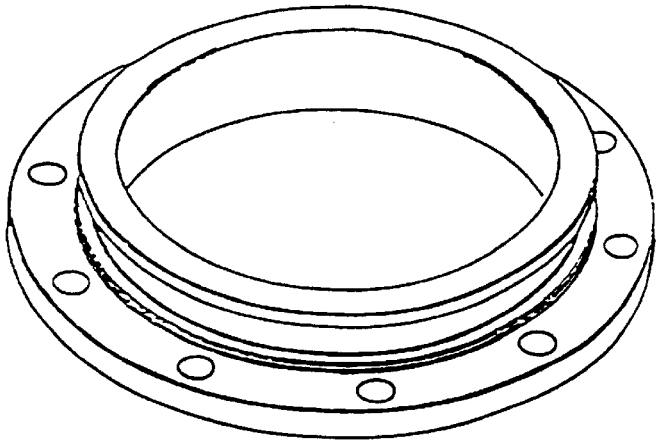
FIG. 1 is a pictorial view of a flange according to the present invention fabricated from silicon carbide and finished using the techniques of the present invention. The exemplary silicon product may have a diameter of 300 mm and a thickness of 50 mm.

A significant feature of the present invention is its ability to utilize conventional machining and finishing equipment to produce a silicon part with a superior surface finish using a significantly reduced amount of the time compared to prior art techniques. A related significant feature of this invention is to utilize conventional machining and finishing equipment to produce a silicon part with a far superior surface finish than that produced according to prior art techniques.

A silicon part finished according to the present invention, even to the unaided eye, appears much more reflective than samples ground with 400 and 600 grit wheels, even though the conventionally ground samples appear to be smooth. Magnification clarifies the nature of the surfaces, and the surface finish produced according to the technique of the present invention is substantially free of pull-outs and tears that are produced by more conventional machining. The roughness of a 200× photo on the part finished according to the present invention may be due to insufficient clean up of prior grinding. Photos of parts clearly indicate that a silicon surface finish according to the present invention is more desirable than a surface hand lapped, and approaches the surface finish of a polished optical flat.

The techniques of the present invention recognize the most critical factors that effect the outcome of the desired surface finish and then reliably control those factors. Factors effecting surface finish include but are not limited to damage on the wheel, wheel balance, run out, rigidity of set up, coolant cleanliness, coolant concentration, wheel dressing, traverse speed, and depth of cut. It is easier to prevent rough surfaces than to correct them once they form a "set pattern" in the material to be finished. It is important to both set up and follow identical previously successful procedures intended to take into consideration the character of the part being finished. If the procedures are bypassed, forgotten, or changed intentionally without testing, the risk of inferior surface finish increases.

It is thus a feature of the present invention to perform each step in the method and during operation of the machine, and to record in detail exactly the steps taken. A change in the procedure may thus be very important. Sometimes there are instances where the surface finish is in tolerance, but the finish has an inferior appearance. The present invention also recognizes that the operator needs to have an ability to concentrate long enough to produce repeated results. It is known that polishing experts lose their performance edge after hours of work. High concentration, close attention to detail, and sufficient breaks to maintain intensity when finishing are thus recommended.

The techniques of the present invention may be used to grind meter-length components and complex shapes. The rough form of the silicon component may be produced utilizing conventional machining techniques. Plates may then be finished according to the techniques of the present invention which are flatter than the 8-wave peak –2-Valley (P-V) requirement.

An important factor in characterization of grinding surfaces is subsurface damage (SSD). Small single crystal silicon samples which were machined and compared to the relative magnitude of SSD left by grinding with several different grinding wheels and the silicon surface finish according to the present invention.

Surface Flatness

Two sizes of flat plates were ground and supplied to a customer who measured flatness with a Wyko interferometer. Insight gained from the surface characterizations was used improve the quality of subsequent works. A summary of the initial measurements is provided in Table 1. Samples are identified as to size and serial number. All were 25 mm (1") thick.

The RMS flatness values for the 38 mm×38 mm (1.5"×1.5") samples was quite good, 1 to 3 waves, as machined. The reason for the significant difference between the RMS and P-V results is significant edge roll-off. The overall P-V was 6.6 waves, and the RMS was 1.32 waves. Lateral dimensions are in inches, and surface flatness and contour steps are in micro-inches. The major portion of the surface is very flat and smooth. Roll-off contributes about 5 to 6 waves for samples A-1 and A-2 and about 10 waves for sample A-3. The specification for these plates was 8 waves, so the first two were acceptable and the third was accepted, although somewhat out of specification.

TABLE 1

Surface flatness results for the square plates using a Wyko surface profiler.

| Sample | Size (mm) | Flatness (Waves) P–V | RMS | Comments |
|---|---|---|---|---|
| A-1 | 38 × 38 | 7.1 | 1.1 | For these three small samples, the entire surface area could be examined with the 100-mm-diamter Wyko profiler. |
| A-2 | 38 × 38 | 6.6 | 1.3 | |
| A-3 | 38 × 38 | 13.5 | 2.9 | |
| B-1 | 150 × 150 | 4.4–5.8 | 0.7–1.2 | Measurements over overlapping 100 mm apertures. |
| B-2 | 150 × 150 | 3.0–6.9 | 0.1–0.8 | Measurements over 100 mm and 38 mm apertures. |
| B-3 | 150 × 150 | * | * | Surfaces flat beyond Wyko sensitivity; Estimated P–V (waves): 4 (entire surface) & 1 (without roll-off) |
| B-4 | 150 × 150 | * | * | |
| B-5 | 150 × 150 | 2.5–4.1 | 0.3–0.5 | Measurements over 30 mm apertures. |
| B-6 | 150 × 150 | 1.2–4.7 | 0.2–0.7 | Measurements over 100 mm and 38 mm apertures |

Because the maximum aperture size of the Wyko instrument used is 100 mm, each set of measurements for the larger 150 mm×150 mm (6"×6") plates listed in Table 1 pertains to only a portion of each of the plate but locations overlap. Most locations were selected to avoid roll-off regions. Sample B-2 measurements were made with and without the roll-off regions. With roll-off, the value of 6.9 waves is within the range observed for all other the plates and is within the customer's 8 wave P-V specification.

Some plates showed concavity and, although they were within the specification, they were reground. Plate B-3 produced no significant print out when examined, the reason being the excellent flatness of the surface and removal of surface damage introduced by prior roughing cuts. There are regions that are very flat, less than 1 wave with a better than 0.25 wave P-V. The initial surface profile of the sample B-2 was over a 100 m (4") diameter region. The RMS was 0.75 waves and the P-V was 3–4 waves.

Figure 2:
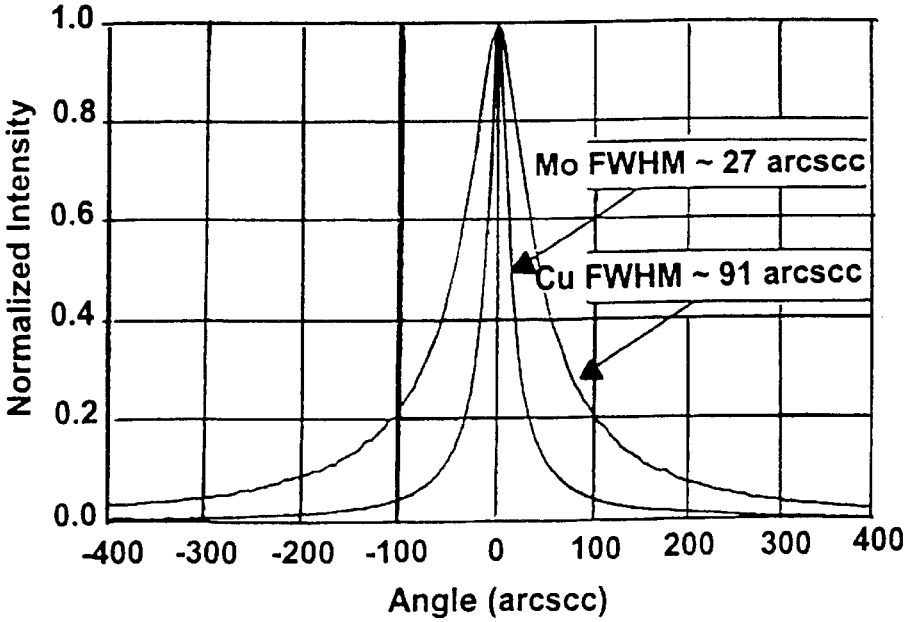
FIG. 2 is a line profile of a surface of a silicon part.

Analysis of all measurements suggests that there is a limiting value of smoothness of about 2 um (100 $\mu$in) P-V, as seen by typically orthogonal line scans or profiles shown in FIG. 2, which depicts line profiles of a typical surface suggesting an attainable surface smoothness of under 2.5 microns P-V on the surface. The excellent flatness of plates B-3 and B-6 was confirmed by measurements with an electronic dial indicator, although there was still as much as 4 waves of roll-off.

Concave plates were rotated 90° and ground, after the initial Wyko examination, to remove the concavity. Subsequently they were too flat to be measured, better than 0.7 wave P-V. The surface inspection data were a key element in achieving flatter surfaces. It provided insight into the surface features that needed improvement. Such an interactive approach warrants consideration when demanding tolerances are required, even at grinding level.

Quantitative Analysis of Subsurface Damage

In order to determine the subsurface damage, four single-crystal silicon samples were prepared, ground, and evaluated using the Advanced Photon Source (APS) x-ray topography system.

The purpose of the analysis was to quantitatively estimate the subsurface damage (SSD) introduced by the grinding of silicon using wheels with bonded abrasives of various particle size. A more careful analysis, which is planned, would determine the thickness of the SSD layer and also shed light on the nature of this damage: mosaicity, residual stress, and dislocation. Mosaicity in a single crystal would broaden the rocking curve. An angular shift in the rocking curve peak of a crystal suggests a change in the d-spacing, i.e., residual stress in the crystal. Loss of photons, determined by integrating the area under the rocking curve and comparing it with a perfect crystal, can be due to destruction of crystalline structure in the damaged layer.

Four silicon substrates, each 70 mm in diameter and 22 mm thick were prepared. They are cut from a disk perpendicular to the growth direction of a (100 ) single-crystal boule. They were all ground flat on both faces and then completely etched in a hydrofluoric/nitric acid solution to remove all damage introduced during machining. The measured full width half maximum (FWHM) of the rocking curves of the samples at the copper K×energy (8048 eV) was about the ideal value of about 3.6 arcseconds.

The etched samples were then ground on one side with resin-bonded grinding wheels having different imbedded particle sizes. The grinding history of the samples is shown in Table 2. The surface texture of these samples is apparent at 20×magnification. The backsides of the samples were all (inadvertently) ground with the 400 grit wheel to flatten the etching-introduced waviness. Given the thickness of the disks, grinding of the backside of the samples was not expected to affect subsequent measurements of front side rocking curves.

TABLE 2

Grinding history of the single-crystal silicon samples and the measured rocking curve FWHMs at 8 keV photon energy.

| Sample | Diamond abrasive particle (μm)/(mesh size) used & the thickness of layers removed in the operation | | | | Rocking curve |
|---|---|---|---|---|---|
| | 46/400 | 30/600 | 25/800 | * | FWHM (arcsec) |
| | Thickness of the material removed (μm) | | | | |
| A | ~1000 | — | — | — | 91 |
| B | ~1000 | 680 | — | — | 40 |
| C | ~1000 | 680 | 160 | — | 36 |
| D | ~1000 | 680 | 160 | 75 | 25 |
| Perfect Crystal | — | — | — | — | 4 |

Figure 3:
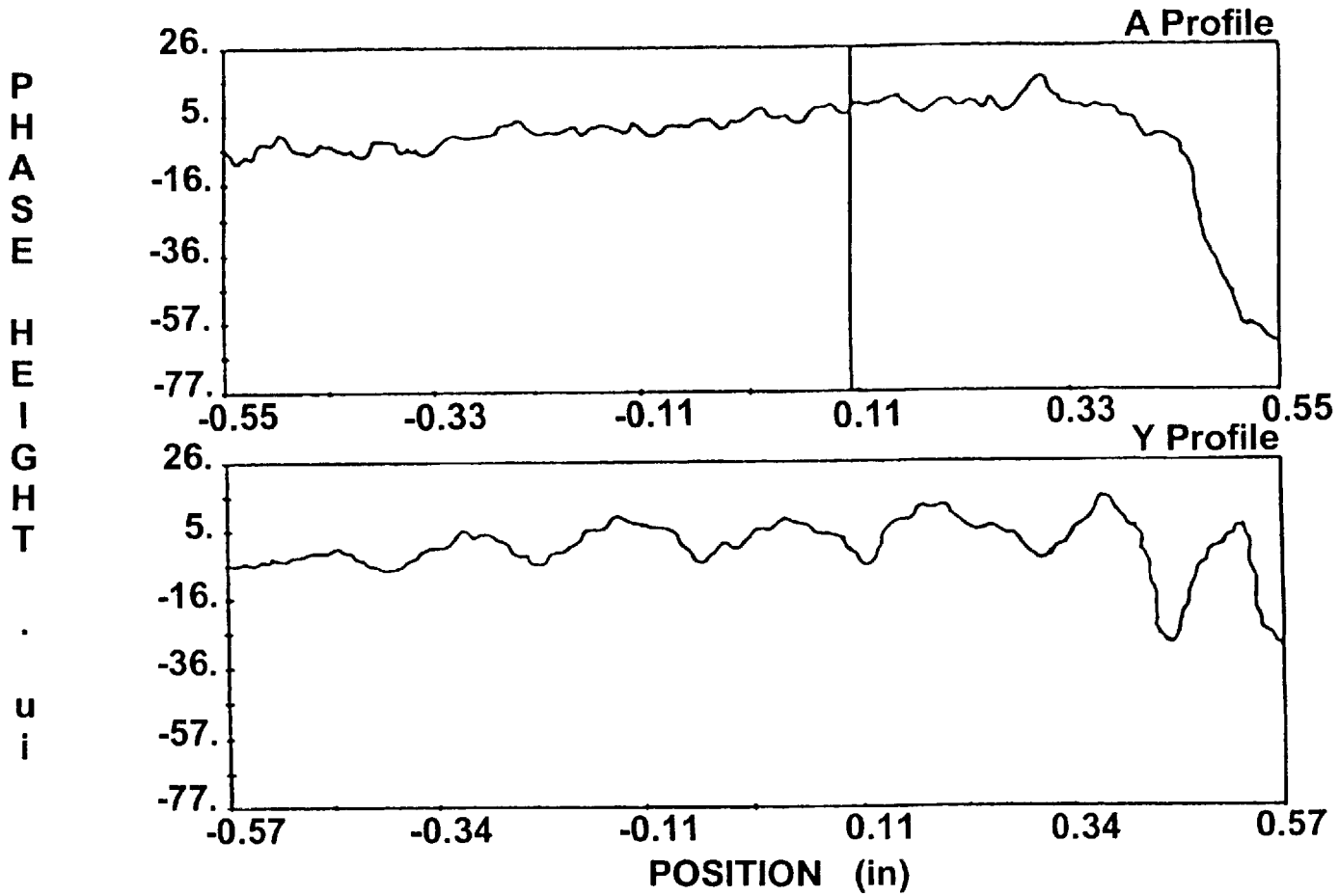
FIG. 3 is a plot of intensity versus angle for four sample parts.

After the grinding operations noted in Table 2, the samples were evaluated one by one at the APS x-ray topography lab. FIG. 3 shows the raw racking curves of four silicon samples for 400 planes measured at the Cu K×energy. The area under each curve relative to that of sample A is noted. Higher intensity (smaller curve width) indicates lower subsurface damage. Shift in the position of the waves along the x-axis is of no significance and is due to mounting of samples.

The areas under the curves, normalized to 100 for sample A, are also noted. In these measurements, the entire surface of each crystal was sampled. Other measurements examining smaller areas of the sample produced the same results, indicative of the uniformity of damage across the ample surface. The angular shifts in the rocking curves seen in FIG. 3 are due to sample mounting and have no significance.

Figure 4:
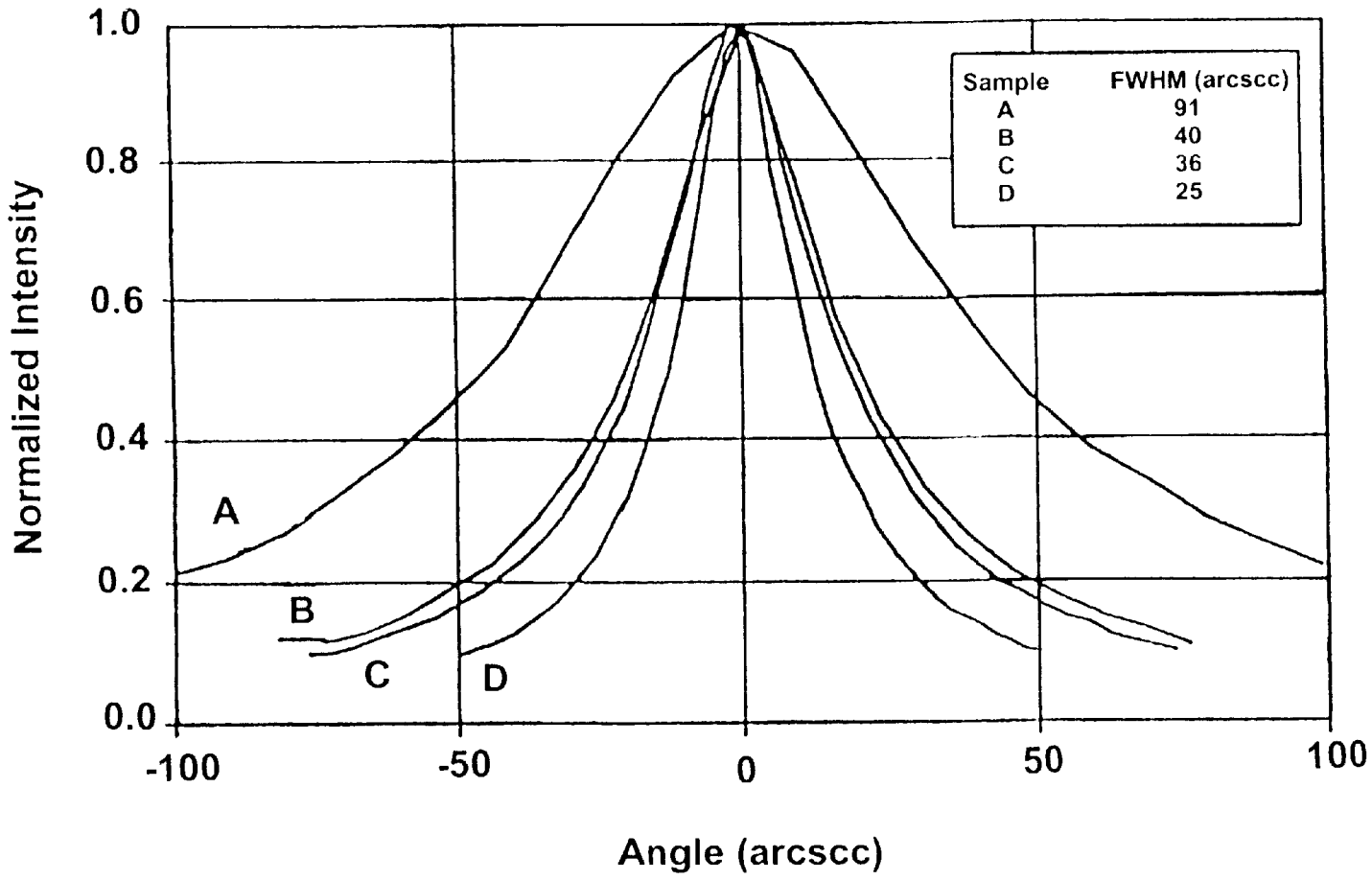
FIG. 4 is a plot of normalized intensity versus angle for four sample parts.

In FIG. 4, these same rocking curves are shown with their peak intensity normalized to unity. Their FWHMs, indicative of SSD, correlate well with the abrasive sizes (see Table 2) used in their grinding. The FWHM values ranging from 91 arc seconds for sample A to 25 arc seconds for the sample D (present invention) are substantially higher than the 4 arc seconds value for an undamaged crystal. A more detailed analysis of these rocking curves, particularly their wings, can provide valuable information about subsurface damage. However, the data in terms of the FWHM presented here are sufficient to provide qualitative information about the damage introduced by various grinding operations. While the SSD in the sample according to the present invention is substantially smaller than in other samples, there remains a thin damaged layer.

Figure 5:
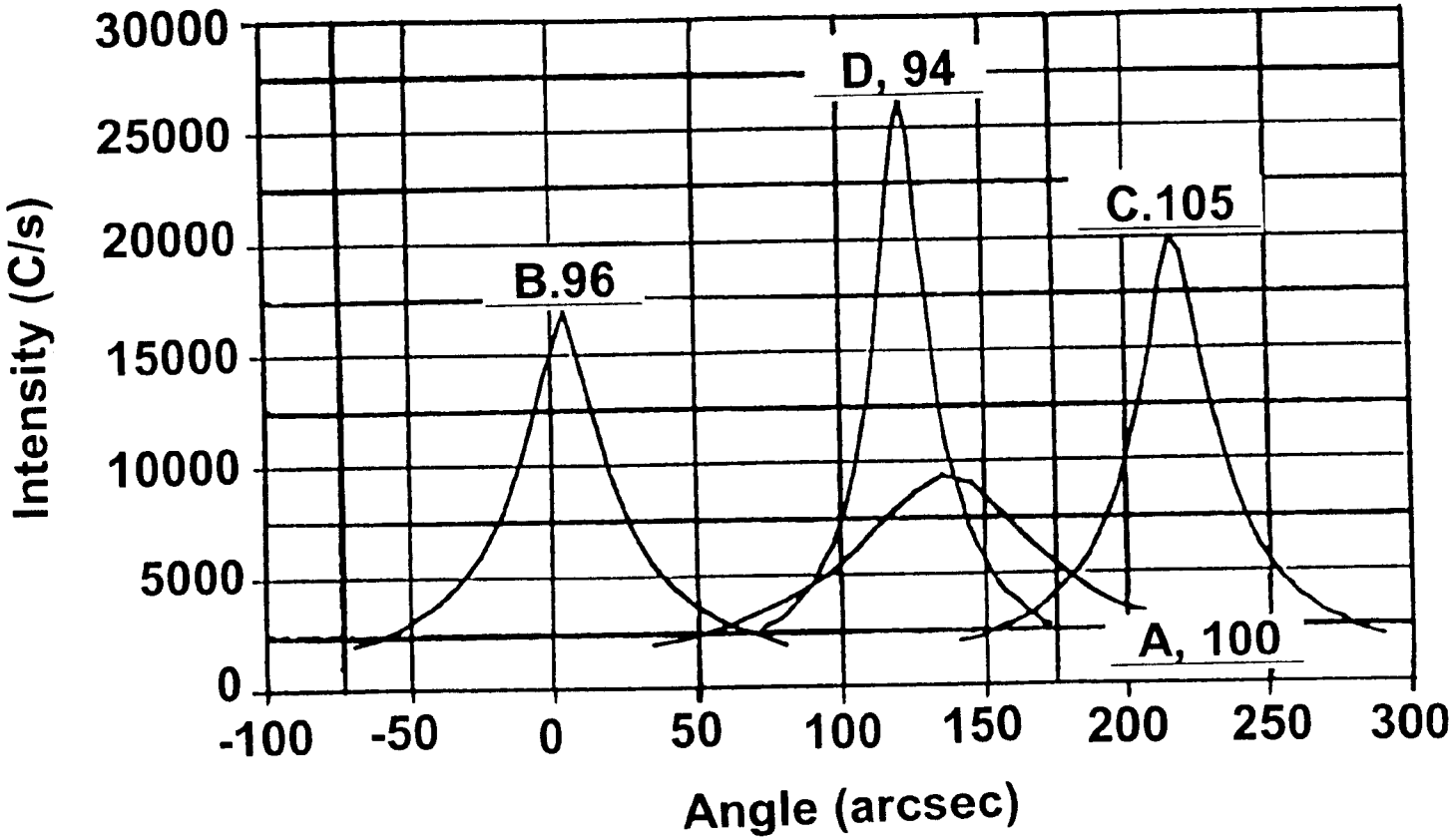
FIG. 5 is a plot of normalized intensity versus angle plot for two sample parts.

In an attempt to provide additional qualitative information about the depth of SSD, x-rays from a molybdenum (Mo) target (17 keV) were used to obtain the rocking curve for sample A. The extinction and attenuation depths of photons from a Cu target for Is (400) are 15 μm and 60 μm, respectively. For a Mo target, these are 40 and 655 μm, respectively. The FWHM of the rocking curve for a perfect Is (400) crystal at Mo energy is 1.4 arc seconds compared with 3.6 at Cu energy. The normalized rocking curves for sample A at 8 and 17 keV photon energies are shown in FIG. 5. Because a higher fraction of the more penetrating 17 keV photons diffract from the depth of the silicon sample, the much smaller FWHM of the rocking curve at 17 keV is a further indication that the SSD is confined to a thin layer at the surface. The rocking curve measurements here and the values of the extinction depths indicated above seemed to suggest that subsurface damage depth might be about the abrasive particle size as in glass substrates. In fact, an empirical equation SSD (μm)=1.07 $L^{3/4}$ is suggested, where L is the abrasive particle size.

In order to provide a precise estimation of subsurface damage in the samples, the front sides of all samples were etched in a hydrofluoric/nitric acid solution. The front surface of each sample was partially painted to avoid being etched. All four samples were then mounted on a Teflon holder and dipped into the etchant in such a way that four different layers of varying thickness are etched away from each sample. In each sample, the bottom segment was etched 15 minutes, the next segment for 9 minutes, the following one for 6 minutes, and the top portion dipped last into the etchant for 3 minutes. The reason for painting parts of the surface to avoid etching was to provide a reference for measuring the thickness of the etched layers, and to allow a second etching operation should that become necessary.

Measurements indicated that layers ranging from 8 to 45 μm in thickness had been removed from each sample, somewhat more than what was intended. The samples were analyzed on the x-ray topography system. Results indicated that essentially all of the damage had been removed; only a very small residual strain was observed in the least etched part of sample A, indicating that the most coarse grinding operation (with the 45 μm mesh) seems to have introduced a 10–15 μm deep SSD. Kersian correlated surface roughness with SSD as determined by scanning infrared depolarization, photothermal, and high-resolution transmission electron microscopy techniques. Ball et al. correlated SSD with surface roughness by observing the depth of microcracking at high magnification. The infrared data of Kersian were favored for the correlation of the grind according to the present invention while the Ball data were used directly for all surfaces. Kersian and Ball expectations regarding SSD were confirmed by the above tests. This approach bracketed the estimated range of SSD for each surface.

Detailed inspection of ground surfaces is a valuable tool for improving the machining process. According to the present invention, the surfaces produced were within a few waves of the desired flat configuration. Although the characterized parts were not for an optical application, their quality suggests that grinding technology may be approaching the point where lapping time can be reduced or eliminated for some types of optics. Two significant lessons were learned from the interferometer examinations of the plates that were characterized. First, the use of wasters to surround the plates should be considered as a means of minimizing roll-off at edges. Second, the amount of material removal required to eliminate surface damage from diamond wheels employed for roughing cuts can be determined. Improvement in the visually observed smoothness of the surface is not an adequate indication that prior surface damage has been removed but interferometer techniques appear to provide such information. Optical evaluation of the surfaces does not quantitize the subsurface damage, however. Other techniques, such as the measurement of residual strain, can provide guidance in this regard. Results of the x-ray analysis of the ground surfaces demonstrate the value of this technique for the definitive information about SSD.

Preferred Finishing Procedure—PFP (1) Inspect machine tool table for flatness, rigidity and damage.

(2) Manufacture custom plastic shims and cover measuring instruments to protec part surfaces.

(3) Install part to receive PFP in holding device. Inspect setup to ensure rigidity of work piece is stable.

(4) Cover work piece while dressing wheel and preparing machine setup to protect work piece from damage.

(5) Inspect PFP grinding wheel.

(6) Check PFP grinding wheel for mechanical concentricity and correct if required.

(7) Check PFP grinding wheel for static balance and correct if required. This will only correct radial unbalance in one plane.

(8) Check PFP grinding wheel for dynamic balance and correct if required. This will correct oscillation and high frequency.

(9) Check machine tool spindle run out. Spindle must be within +/−0.0001 TIR.

(10) Install wheel with blotters and tighten with torque wrench to 50 ft. lbs. Use paper donut gaskets approximately 0.006 thick for vibration dampening.

(11) Check for wheel run out. PFP grinding wheel must be within +/−0.0001 TR.

(12) Rotate spindle at required RPM and check spindle vibration.

(13) Use white color-coded dressing stick (½×¾×6 Lunzer #ALIV 1200H21) mounted in a suitable holding device on worktable. Dress wheel with 0.0002 depth @ 50 ipm feed while simultaneously using reciprocating power table.

(14) Repeat step 13 three times until wheel is concentric.

(15) Use orange color-coded dressing stick (1×1×6 Lunzer #38A80-KV) to clean bond from diamond surface. Apply by hand.

(16) Apply graphite to wheel surface by hand or use auto graphite feeding device to achieve required lubricity.

(17) Check spindle for vibration. Leave spindle running during non-operational periods. This ensures consistent balancing. If spindle is turned off repeat the dressing procedural steps.

(18) Coolant Requirement: Use manufactures mixing instructions and substitute regular water with $D_iH_2O$. Coolant concentration 4.0–6.7.

(19) Hi-pressure, hi-volume multidirectional coolant system and procedures shall be used. Loss of or lack of coolant will cause failures.

(20) Periodically check for increase of spindle vibration.

(21) Apply PFP to silicon part beginning with the 400-grit PFP grinding wheel. Depth of cut not to exceed 0.002 with a cross feed rate not to exceed 0.100 per stroke. Use machine tools's standard traverse feed rate.

(22) Change to PFP 600 grit wheel. Repeating wheel installation procedures. Depth of cut not to exceed 0.001 with a cross feed rate not to exceed 0.075 per stroke. Use machine tool's standard traverse feed rate. Remove 0.016 total stock.

(23) Change to PFP 800 grit wheel. Repeating wheel installation procedures. Depth of cut not to exceed 0.001 with a cross feed rate not to exceed 0.075 per stroke. Use machine tool's standard traverse feed rate. Remove 0.010 total stock.

(24) Change to PFP 1200 grit wheel. Repeating wheel installation procedures. Depth of cut not to exceed 0.0002 with a cross feed rate not to exceed 0.050 per stroke. Use machine tool's standard traverse feed rate. Remove 0.008 total stock. On the last two incremental feed steps restrict feed rate to one increment of 0.0002 per three complete cross stroke passes.

(25) Ensure steps 21–24 have significant coolant flow and pressure. Reference step 19.

(26) Inspect for damage and clean up after each step.

(27) Use gloves when handling silicon material.

The silicon part preferably is cooled with a plurality of cooling lines both when grinding the silicon part with the grinding wheel and when finishing the silicon part with the one or more grit materials. As indicated, the coolant preferably is changed before grinding another part. Conceptionally other enhanced lubricity materials may work, although graphite is economical and is preferred. The plurality of grit materials preferably have a grit variation factor of at least 8. For example, a plurality of grit materials varying from a 200 grit to a 1600 grit would have a grit material variation factor of 8, while grit materials varying from about 200 grit to 800 grit would have a grit material variation factor of 4. The grinding wheel is preferably checked for one or more mechanical runout, static balance, dynamic balance each time the grinding wheel is used. The rotatable spindle for holding the part should be checked for vibration frequently.

According the method of the invention, the silicon part is covered while grinding the surface of the part utilizing an overhead cover having a surface area at least four times a maximum nominal diameter of the part, and preferably a surface area at least ten times a maximum nominal diameter of the part. Those skilled in the art will appreciate that, regardless of the three dimensional configuration of the part, the part may normally be construed to have a nominal or average part diameter, and thus the overhead cover for a part having a nominal diameter of 50 cm. has a surface protective area of at least 200 cm., and preferably has a surface area of at least 500 cm. in order to adequately cover the part while grinding the surface of the part.

Modified Finishing Procedure—MFP

Improvements in the change to PFP for silicon may be accomplished by focusing on the fine particle removal rate by chemical/mechanical methods.

Wheel selection, dressing, coolant dielectric constant, coolant PH /purity and copious amount of coolant applied to work piece are ingredients to the previous success. Underbalanced and untrue wheels, using incorrect dressing sticks, diluted, contaminated and inadequate coolant are contributors to scratches, honeycomb and "orange peel" finishes.

The next step involves more attention to using chemical reaction and assistance in removing fine particles. The mechanical should be improved by waxing on wasters to allow for "rise and drop". This will give a true plane in the work piece, but the chemical means are the key to preventing glazing of the wheel and overloading of pressure sensitive silicon material.

An aquarium preferably is in place, around the work piece, when the PFP for silicon is applied. A door, designed into the device, should be left open to prevent filling of coolant at this time. After achieving the PFP and after performing in-process cleaning procedures (using $D_iH_2O$) the following method may be practiced:

(1) Wheels must be static and dynamically balanced.

(2) Redress 9–12 micron resin bonded wheel with a disposable commercial single diamond mounted to table of machine. Note: after several operations this dresser must be replaced.

(3) Hand dress same wheel with dressing stick #RED 38A80-KV.

(4) Leave spindle running and move wheel into active area and close aquarium door(s).

(5) Use proper machinists methods to locate wheel withing close proximity of surface to be machined. Not standoff distance. This will be a blind operation.

(6) Clean and change coolant in machine. (4.7–6.0 concentration and 8.5 PH min.)

(7) Check Spindle Saturation for machine (stabilized at optimum temp.).

(8) Fill aquarium with coolant but leave room for 1 part colloidal graphite per volume.

(9) Hand feed wheel towards work piece and stand-off minimum of 0.002".

(10) Begin normal machine movements and feed in increments of 0.0001".

(11) Note: Chemical polishing has already begun . . . allowing "sparking out" time.

(12) When physical contact is made allow stabilizing contact pressure by not feeding again for 30 minutes.

(13) Graphite allows lubricity, Dielectric constant and PH allows cutting, coolant submersion allows permeation of microscopic grain of wheel, all of which prevents wheel glazing.

(14) A total of 0.0008" must be removed by repeating 30 minute intervals (0.0001 per cut).

(15) After last feed allow machine to run for 1½ hrs. for final "spark out".

(16) Stop machine movements when wheel clears work piece but leave spindle running.

(17) Vacuum out aquarium and rinse work piece with $D_iH_2O$.

(18) Visually inspect work piece using high-power lighting and magnifiers.

(19) Repeat process if necessary but only remove a total of 0.0004" (0.0001/cut).

(20) Repeat inspection and repeat process a third time, if necessary (0.0002 total).

(21) If visual inspection fails, possible contributor is damaged or stressed material.

Simplified Finishing Procedure—SFP

Using almost any grit, if the operator takes enough micro depth cuts, a super finish will result. Time needed must not be an issue. Grinding with an average grit (180–220) wheel and taking multiple light finishing cuts, then acid etching will produce a high quality finish.

A high quality finished part may thus be produced by the method of the present invention, with the final finishing involving a plurality of grit materials having substantially different grit sizes. The grit sizes of the grit material in the final finishing operation preferably vary from greater than about 200 grit to less than about 800 grit. The grinding wheel is dressed to a depth desired for the part to be finished.

Conventional grinding then sequential lapping will also produce a high quality finish.

The techniques of the present invention provide significant advantages when finishing silicon parts compared to prior art techniques:

(1) Reduction of environmentally hazardous chemicals needed.

(2) Optimization of available time-constraints.

(3) Increased accuracy of complicated shapes.

(4) Ease of accuracy of simple planes and contours.

(5) Less risky movements and handling of sensitive silicon material.

While preferred embodiments of the present invention have been illustrated in detail, it is apparent that modifications and adaptations of the preferred embodiments and methods will occur to those skilled in the art. However, it is to be expressly understood that such modifications and methods are within the spirit and scope of the present invention as set forth in the following claims.

What is claimed is:

1. A method of finishing a silicon part using (1) a rotatable grinding wheel having diamond particles and a bonding agent, and (2) using one or more grit materials, the method comprising:

(a) dressing the rotatable grinding wheel to form a wheel with a grinding surface having a plurality of diamond particles forming a substantially uniform diamond particle grinding diameter;

(b) thereafter removing bonding material from the grinding wheel surface and from between the plurality of diamond particles without significant removal of the plurality of diamond particles;

(c) thereafter applying an enhanced lubricity material to the grinding wheel;

(d) thereafter grinding a surface of the silicon part with the rotatable grinding wheel; and (e) thereafter finishing the ground surface of the silicon part with the one or more grit materials.

2. The method as defined in claim 1, wherein the silicon part is finished with a plurality of grit materials having substantially different grit sizes.

3. The method of finishing a silicon part as defined in claim 2, wherein the plurality of grit materials vary from greater than about 200 grit to less than about 800 grit.

4. The method as defined in claim 1, wherein the silicon part is cooled with a plurality of cooling lines both when grinding the silicon part with the grinding wheel and when finishing the silicon part with the one or more grit materials.

5. The method of finishing a silicon part as defined in claim 4, further comprising:

changing coolant for grinding another part.

6. The method of finishing a silicon part as defined in claim 1, wherein the enhanced lubricity material comprises graphite.

7. The method of finishing a silicon part as defined in claim 1, further comprising:

covering the part while grinding the surface of the part with an overhead cover having a surface area at least four times a maximum nominal diameter of the part.

8. The method of finishing a silicon part as defined in claim 1, further comprising:

checking the grinding wheel for one or more of a mechanical runnout, a static balance, and a dynamic balance.

9. The method of finishing a silicon part as defined in claim 1, further comprising:

checking a rotatable spindle for holding the part for vibration.

10. The method of finishing a silicon part as defined in claim 1, further comprising:

dressing the grinding wheel to a desired depth.

11. The method of finishing a silicon part as defined in claim 1, wherein the one or more grit material comprise a plurality of grit materials having a grit variation factor of at least 8.

12. A method of finishing a silicon part using (1) a rotatable grinding wheel having diamond particles and a bonding agent, and (2) a plurality of grit materials, the method comprising:

(a) dressing the rotatable grinding wheel to form a wheel with a grinding surface having a plurality of diamond particles forming a substantially uniform diamond particle grinding diameter;

(b) thereafter removing bonding material from the grinding wheel surface and from between the plurality of diamond particles without significant removal of the plurality of diamond particles;

(c) thereafter applying an enhanced lubricity material to the grinding wheel;

(d) thereafter grinding a surface of the silicon part with the rotatable grinding wheel while cooling the silicon part with a plurality of cooling lines; and (e) thereafter finishing the ground surface of the silicon part with the plurality of grit materials having substantially different grit sizes.

13. The method of finishing a silicon part as defined in claim 12, wherein the plurality of grit materials vary from greater than about 200 grit to less than about 800 grit.

14. The method as defined in claim 12, wherein the silicon part is cooled with a plurality of cooling lines when finishing the silicon part with the plurality of grit materials.

15. The method of finishing a silicon part as defined in claim 12, further comprising:

covering the part while grinding the surface of the part with an overhead cover having a surface area at least four times a maximum nominal diameter of the part.

16. The method of finishing a silicon part as defined in claim 12, further comprising:

checking the grinding wheel for one or more of a mechanical runnout, a static balance, and a dynamic balance.

17. The method of finishing a silicon part as defined in claim 12, wherein the plurality of grit materials have a grit variation factor of at least 8.

18. A method of finishing a silicon part using (1) a rotatable grinding wheel having diamond particles and a bonding agent, and (2) one or more grit materials, the method comprising:

(a) dressing the rotatable grinding wheel to form a wheel with a grinding surface having a plurality of diamond particles forming a substantially uniform diamond particle grinding diameter;

(b) thereafter removing bonding material from the grinding wheel surface and from between the plurality of diamond particles without significant removal of the plurality of diamond particles;

(c) thereafter applying an enhanced lubricity material to the grinding wheel;

(d) thereafter grinding a surface of the silicon part with the rotatable grinding wheel while cooling the silicon part with a plurality of cooling lines; and (e) thereafter finishing the ground surface of the silicon part with the one or more grit materials while cooling the silicon part with a plurality of cooling lines.

19. The method of finishing a silicon part as defined in claim 18, further comprising:

covering the part while grinding the surface of the part with an overhead cover having a surface area at least four times a maximum nominal diameter of the part.

20. The method of finishing a silicon part as defined in claim 18, wherein the one or more grit material comprise a plurality of grit materials having a grit variation factor of at least 8.

* * * * *